US010010836B2

(12) United States Patent
Ritvanen

(10) Patent No.: US 10,010,836 B2
(45) Date of Patent: Jul. 3, 2018

(54) METHOD FOR FINELY FEEDING GRANULAR SOLIDS INTO LIQUID

(71) Applicant: S.T. Ritvanen Oy, Raisio (FI)

(72) Inventor: Tapio Ritvanen, Raisio (FI)

(73) Assignee: S. T. Ritvanen OY, Raisio (FI)

( * ) Notice: Subject to any disclaimer, the term of this patent is extended or adjusted under 35 U.S.C. 154(b) by 864 days.

(21) Appl. No.: 14/395,340

(22) PCT Filed: Apr. 25, 2013

(86) PCT No.: PCT/FI2013/050469

§ 371 (c)(1),
(2) Date: Oct. 17, 2014

(87) PCT Pub. No.: WO2013/160562

PCT Pub. Date: Oct. 31, 2013

(65) Prior Publication Data

US 2015/0133035 A1 May 14, 2015

(30) Foreign Application Priority Data

Apr. 27, 2012 (FI) ..... 20125469

(51) Int. Cl.
*B01F 3/12* (2006.01)
*B01F 5/24* (2006.01)
(Continued)

(52) U.S. Cl.
CPC ..... *B01F 5/246* (2013.01); *B01F 3/12* (2013.01); *B01F 5/0206* (2013.01); *B01F 15/0235* (2013.01); *B01F 2003/125* (2013.01)

(58) Field of Classification Search
CPC .... B01F 5/246; B01F 15/0235; B01F 5/0206; B01F 3/12; B01F 2003/125
See application file for complete search history.

(56) References Cited

U.S. PATENT DOCUMENTS 2,590,541 A * 3/1952 Geh ..... B01F 1/0016 422/263
2,906,607 A * 9/1959 Jamison ..... B01F 5/0206 261/77
(Continued)

FOREIGN PATENT DOCUMENTS

DE 1174744 7/1964
EP 0 768 113 A1 4/1997
(Continued)

OTHER PUBLICATIONS

Machine translation for EP 1144101 B9.*
(Continued)

*Primary Examiner* — Charles Cooley
(74) *Attorney, Agent, or Firm* — FisherBroyles, LLP

(57) ABSTRACT

A method for finely feeding granular solids into a liquid, in which method granular solids and a liquid are fed into a mixing space and mixed together, and a mixture of small solid particles and liquid is discharged from the mixing space. The granular solid matter in the mixing space is subjected to a liquid flow in such a manner the granular solids are brought to roll controllably in a controlled rolling space locating in the mixing space, whereby the grains of the granular solids abrase one another while rolling and tiny particles detaching in abrasion are carried away from the mixing space along with the liquid and large grain particles continue rolling in the controlled rolling space.

6 Claims, 2 Drawing Sheets

(51) Int. Cl.
*B01F 5/02* (2006.01)
*B01F 15/02* (2006.01)

(56) References Cited

U.S. PATENT DOCUMENTS 3,201,093 A * 8/1965 Smith ..... B01F 5/0057 366/136
3,425,669 A * 2/1969 Gaddis ..... B01F 1/0011 366/153.1
3,741,533 A * 6/1973 Winn, Jr. ..... B01F 5/0057 366/136
4,007,921 A * 2/1977 Zingg ..... B01F 3/12 366/10
4,184,771 A * 1/1980 Day ..... B01F 5/0068 366/10
4,345,841 A * 8/1982 Day ..... B01F 5/0057 366/14
5,211,475 A * 5/1993 McDermott ..... B01F 1/0022 222/133
6,039,470 A * 3/2000 Conwell ..... B01F 5/10 366/137
6,065,860 A * 5/2000 Fuchsbichler ..... B01F 1/0022 366/136
6,186,657 B1 * 2/2001 Fuchsbichler ..... B01F 1/00 366/165.4
2008/0074944 A1 * 3/2008 Blechschmitt ..... B01F 5/0212 366/101
2015/0133035 A1 * 5/2015 Ritvanen ..... B01F 5/0206 451/35
2017/0333928 A1 * 11/2017 Chapron ..... B01F 5/043

FOREIGN PATENT DOCUMENTS

| | | | |
|---|---|---|---|
| EP | 1 144 101 | B9 | 10/2001 |
| FI | EP1144101 | T3 | 1/2004 |
| JP | 04063121 | | 2/1992 |
| JP | 2004-338121 | A | 12/2004 |
| WO | 97/46307 | | 12/1997 |
| WO | 00/35569 | | 6/2000 |
| WO | 2009/048337 | A1 | 4/2009 |

OTHER PUBLICATIONS

International Search Report; International Application No. PCT/FI2013/050469; dated Jun. 27, 2013.
Search Report, Application No. 20125469, dated Feb. 1, 2013, 1 page.
Written Opinion, Application No. PCT/FI2013/050469, dated Jun. 26, 2013, pp. 1-6.
Search Report issued in corresponding European Application No. EP13782117.9, pp. 1-6 (dated Nov. 17, 2015).

* cited by examiner

METHOD FOR FINELY FEEDING GRANULAR SOLIDS INTO LIQUID

CROSS-REFERENCE TO RELATED APPLICATIONS

This application is a National Stage application of International Application No. PCT/FI2013/050469, filed Apr. 25, 2013, which claims benefit to Finnish Application No. FI 20125469, filed Apr. 27, 2012, which are incorporated by reference herein in their entirety.

BACKGROUND

Field

The invention relates to a method for finely feeding granular solids into a liquid, in which method granular solids and a liquid are fed into a mixing space and mixed together, and a mixture of small solid particles and liquid is discharged from the mixing space.

Description of the Related Art

Fine-grained feeding of solids into a liquid is needed in a variety of processes. For example, these include processes, in which different ingredients are separated from a liquid, processes, in which continuously circulating cleaning waters and/or cleaning liquids are regenerated during circulation and processes, in which various catalysts are added and/or colours are controlled.

In fields involving the above-mentioned processes there are developed various solutions which are to provide a high-quality fine-grained feed of solids into a liquid. The solutions disclosed in JP publication 2004338121 A1, PCT publication WO 2009/048337 A1, DE publication 1 174 744, EP publication 0 768 113 A1 and US publication 3 727 760 can be given as examples of the above-mentioned known solutions.

A drawback with the prior art has been the complexity and also the fact that the end result achieved by the technique concerned has not been the best possible.

SUMMARY

The object of the invention is to provide a method by which the prior-art drawbacks can be eliminated. This is achieved by a method according to the invention. The method of the invention is characterized in that the granular solid matter in the mixing space is subjected to a liquid flow in such a manner that the liquid flow is driven into a mass consisting of the granular solids and the granular solids are brought to roll controllably in a controlled rolling space locating in the mixing space, whereby the grains of the granular solids abrase one another while rolling and tiny particles detaching in abrasion are carried away from the mixing space along with the liquid and large grain particles continue rolling in the controlled rolling space.

An advantage of the invention is, above all, its simplicity. Another advantage of the invention is that the end result is of very high quality, in other words, the quality of fine-grained feeding of solids in comparison with the quality achievable by the prior art is considerably higher. A further advantage of the invention is that the operating costs of the method according to the invention are very low, for instance, need for maintenance is insignificant in comparison with the prior art.

BRIEF DESCRIPTION OF THE DRAWINGS

In the following, the invention will be explained in greater detail by means of an example described in the attached drawing, in which.

DETAILED DESCRIPTION

Figure 1:
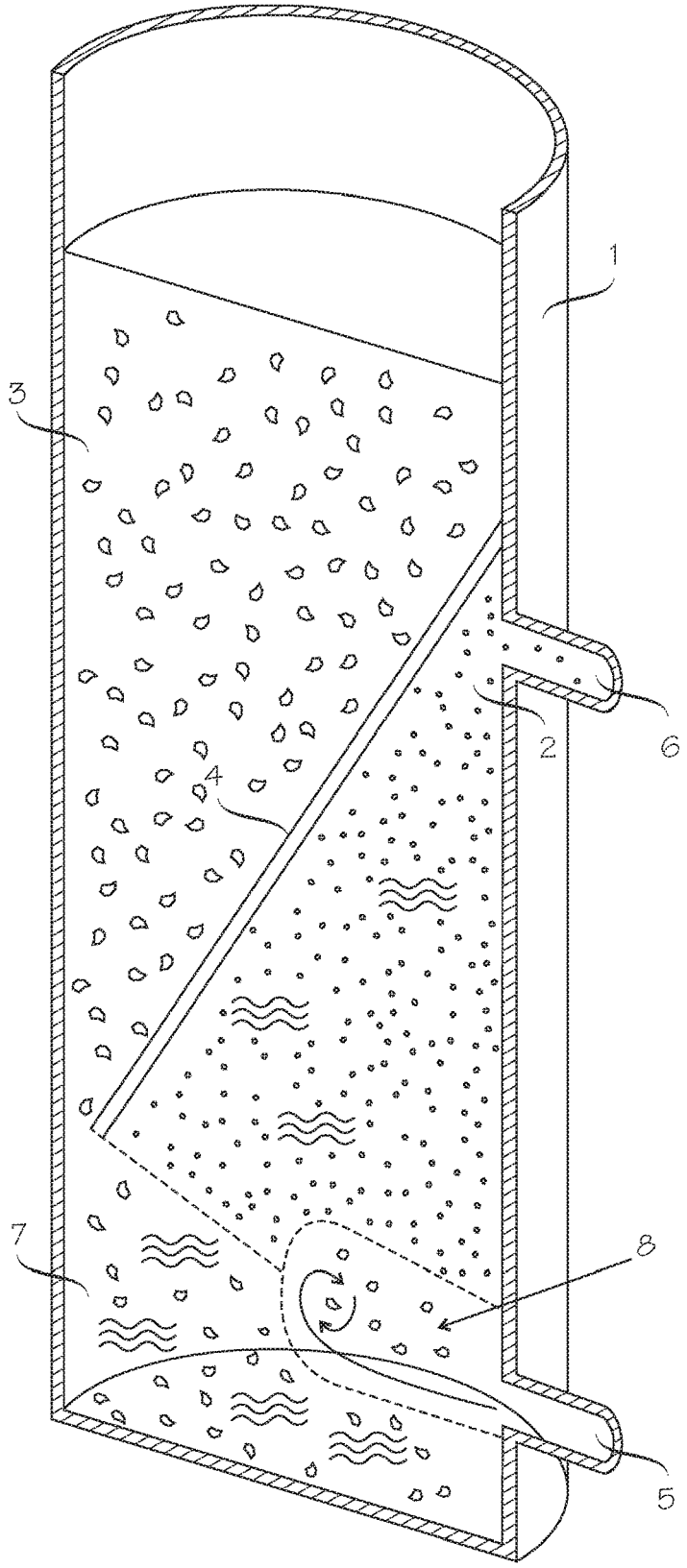
FIG. 1 is a general view of an embodiment utilizing the method of the invention.

FIG. 1 is a general view of an embodiment applying the method of the invention. Reference numeral 1 denotes a container, in which is arranged a mixing space 2 in which granular solid matter 3 and a liquid to be mixed are fed. The mixing space is formed by means of a partition wall 4 in the example of FIG. 1. The liquid is circulated through the mixing space 2 in the container 1 by feeding the liquid into the mixing space through an inlet connection 5 and it is discharged from the mixing space through an outlet connection 6. In the example of FIG. 1 the partition wall 4 is arranged such that the granular solids 3 are able to run via a slot arranged between the partition wall 4 and a wall of the container 1 into the area 7 in the lower part of the mixing space as the process proceeds.

Figure 2:
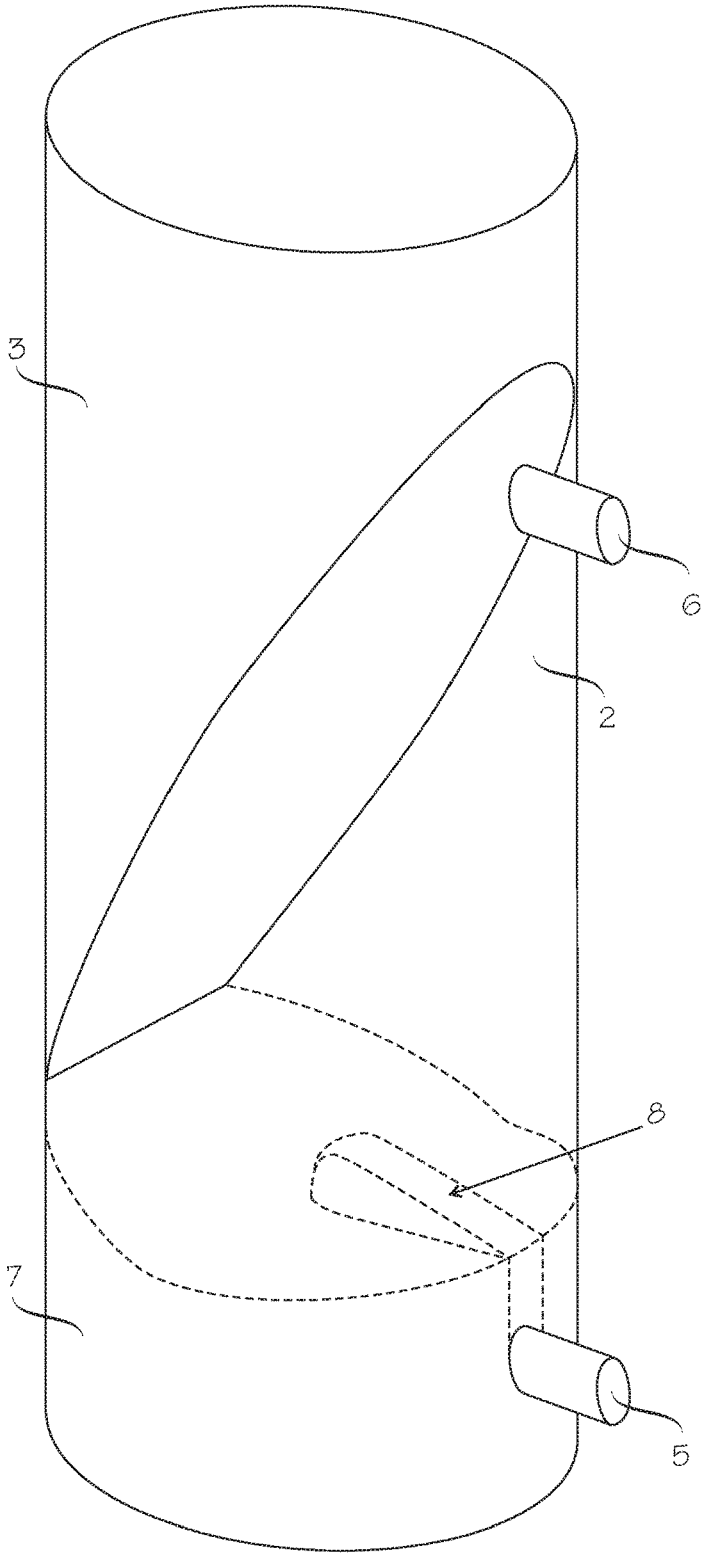
FIG. 2 is a general view of a flow situation, without walls, in the embodiment of FIG. 1.

FIG. 2 illustrates the same matter as FIG. 1, with the difference that FIG. 2 does not show the container and the partition wall, but only the liquid and the granular solids.

In the method of the invention for finely feeding solids into a liquid the essential thing is that the liquid into which the solids are to be fed is arranged to circulate in such a manner that the granular solids will be made roll controllably as a granular mass in a specified rolling space in a phase of the liquid flow circulation, without that the grains would be carried into the actual flow circulation. When the solid grains roll in the controlled rolling space, they collide with one another and simultaneously get chafed, and consequently tiny particles detach therefrom, which tiny particles will be carried along with the actual flow circulation of the liquid, and larger grains will continue to roll in the rolling space.

The geometry of the rolling space for granular solids is defined by several details. For instance, a difference in the specific weight between the solid matter and the liquid affects whether it is possible to utilize gravity in preventing rolling grains from accessing the actual liquid flow circulation through the mixing space.

FIGS. 1 and 2 show a geometrical model, in which fine-grained feed of granular solid matter into a liquid can be implemented by driving a liquid flow into the granular solid matter mass horizontally from the side.

As stated above, in the application of FIGS. 1 and 2, a mixing space 2, via which the liquid is arranged to circulate through connections 5 and 6, is arranged inside a container 1. The liquid is arranged to flow horizontally via an inlet connection 5 so that the liquid flow is driven into a mass consisting of granular solids 3. In the example of FIGS. 1 and 2 the flow is driven into the mass in such a way that the grains of the granular solid matter 3 start rolling by the effect of the liquid running via the inlet connection 5. The rolling takes place in a controlled rolling space 8.

By arranging the mixing space 2 to be sufficiently large in relation to the rolling space 8 a situation is provided, in which the grains of the granular solid matter rolling in the mixing space 8 do not come into contact with any structure defining the mixing space 2, for instance, with a partition wall 2 and/or a wall of the container 1. In that case the grinding process of the solid matter 3 does not wear any part of the apparatus. The above involves two significant advantageous features. Firstly, the maintenance costs will reduce, and secondly, harmful particles originating from the structure of the apparatus will not end up in the liquid circulation.

Because the cross sectional area of the mixing space 2 at the rolling space 8 is considerably larger than the cross sectional area of the inlet connection 5, the flow rate of the circulating liquid within this area will be so low that the grains of the granular solids move along with the liquid only for a while and then sink in order to soon restart moving along with the flow. The motion of the grains of the granular solids in the rolling space is relatively slow, and consequently the grains abrase very slowly, and thus fine-grained abrasion particles will be carried little by little along with the circulating liquid.

Slow abrasion of grains taking place in the rolling space 8 is replaced by a refill from a grain mass running from an area 7. A partition wall 4 retains a larger amount of granular solids in order for not producing an excessive counterpressure to the movement of the circulating liquid.

FIG. 2 shows the same features as FIG. 1. However, FIG. 2 reveals better the location of the granular solids, for instance, in the area 7, and also the essence of the rolling space 8.

In the example of FIGS. 1 and 2 the liquid flow is directed horizontally to the granular solid matter. The granular solid matter is mostly heavier than the liquid. In that case the rolling of the granular solid matter, in order to abrase it, is advantageously implemented by guiding the liquid circulation through the granular mass from below upward, whereby gravity makes the grains lifted by the circulation sink in the rolling and the liquid circulation lifts them up again. This basic principle is applied also in the example of FIGS. 1 and 2, in which a horizontal liquid flow turns upwardly and the flow lifts grains upwardly and gravity, in turn, draws the grains down, as described above.

The smaller the difference in specific weights between the solid matter and the liquid, the more the liquid circulation rate is to be reduced in the rolling space 8, in order that the grains will not be carried along with the circulation, or vice versa. In that case it is advantageous to arrange in the liquid circulation a substantially expanding space, on the bottom of which is applied a desired amount of granular solids. An arrangement of this kind is shown in FIGS. 1 and 2.

As described above, in the example of FIGS. 1 and 2 a flow is directed horizontally into the granular solid matter. This is not the only possibility, however. The circulating liquid may also be directed vertically, for instance, from above downward, close to the surface of the granular solids, whereby the liquid flow is driven vertically a short distance into the granular solid matter and turns then upwards bringing along grains that rise into a crater around a hole formed in the granular solid matter. The obtained crater does not remain high, however, when a new hole is being bored from below into the granular solid matter, but the grains run back into the bored hole providing the desired rolling, i.e. the rolling space. Naturally, the direction in which the flow is directed into the granular solid matter may vary freely, in other words, the direction may be other than what is described above.

In connection with the above applications, it is also possible to use various screens, if so needed, to limit the grains being carried away from the rolling space 8 into the liquid circulation.

In the above, the invention is described by means of the application example of FIGS. 1 and 2. The invention is not limited in any way to said example, however, but it is obvious that other solutions are also possible. FIG. 1 shows a cylindrical container, for instance. It is obvious that the container may be different from the cylindrical container shown in the figures, etc.

The invention may be freely modified within the scope of the claims.

What is claimed is:

1. A method to finely feed granular solids into a liquid, in which method granular solids and a liquid are fed into a mixing space and mixed together such that the liquid is fed via a first inlet connection into the mixing space and the granular solids are fed via a second inlet connection into the mixing space, and a mixture of small solid particles and liquid is discharged from the mixing space via an outlet connection, the granular solid matter in the mixing space being subjected to a liquid flow in such a manner that the liquid flow is driven into a mass consisting of the granular solids and the granular solids are brought to roll controllably in a controlled rolling space locating in the mixing space, whereby the grains of the granular solids abrase one another while rolling and tiny particles detaching in abrasion are carried away from the mixing space along with the liquid and large grain particles continue rolling in the controlled rolling space.

2. The method of claim 1, wherein the liquid flow is directed horizontally into the granular solid matter in the mixing space.

3. The method of claim 1, wherein the liquid flow is directed vertically into the granular solid matter in the mixing space.

4. The method of claim 3, wherein the liquid flow is directed into the granular solid matter from above in a downward direction, close to a surface of the granular solid matter.

5. The method of claim 1, wherein the liquid flow into the granular solid matter is directed in such a way that the flow rises in the granular solid matter from below in an upward direction, whereby the liquid flow lifts grains of the granular solids therewith upwardly and gravity makes the grains sink, respectively.

6. The method of claim 1, wherein the rolling space is arranged at a distance from structures delimiting the mixing space.

* * * * *